United States Patent [19]

Cargill

[11] Patent Number: 4,688,481

[45] Date of Patent: Aug. 25, 1987

[54] DOCUMENT FEEDING AND PRINTING APPARATUS

[75] Inventor: N. Allen Cargill, Warminster, Pa.

[73] Assignee: Technitrol, Inc., Philadelphia, Pa.

[21] Appl. No.: 859,331

[22] Filed: May 5, 1986

[51] Int. Cl.[4] ..... B41F 13/24

[52] U.S. Cl. ..... 101/233; 101/238; 101/240

[58] Field of Search ..... 101/233–240

[56] References Cited

U.S. PATENT DOCUMENTS

| | | | |
|---|---|---|---|
| 3,623,805 | 11/1971 | Egnaczak | 101/233 |
| 3,626,846 | 12/1971 | Wiegert | 101/233 |
| 4,015,523 | 4/1977 | Evans et al. | 101/233 |
| 4,362,100 | 12/1982 | Wu | 101/233 |
| 4,399,750 | 8/1983 | O'Brien | 101/233 |
| 4,470,349 | 9/1984 | Godlewski | 101/233 |
| 4,561,352 | 12/1985 | Svyatsky et al. | 101/233 |

*Primary Examiner*—E. H. Eickholt

*Attorney, Agent, or Firm*—Frank A. Follmer

[57] ABSTRACT

A document printer in which a print drum is driven by a direct current electric motor whose voltage is controlled by a first voltage regulator circuit for supplying a first voltage to the motor during a non-printing operating condition and a voltage boost circuit for supplying a higher voltage to the motor during a printing operating condition so that the same document feed rate is maintained throughout the operation of the device.

5 Claims, 2 Drawing Figures

DOCUMENT FEEDING AND PRINTING APPARATUS

BACKGROUND OF THE INVENTION

High speed document feeding and printing apparatus, such as those used for endorsing food stamps, personal checks and similar documents with a fixed message, generally utilize a print drum cooperating with a platen and an electric motor for driving the print drum. While it is desirable to operate the apparatus at a constant document feed rate, this is difficult to achieve because of the varying loads placed on the motor during the operating conditions of printing and non-printing. The problem is more severe with high speed document feeding and printing apparatus such as an endorser wherein the document feed rate may be of the order of 600 documents per minute.

SUMMARY OF THE INVENTION

It is the general object of the invention to provide an imprived apparatus for feeding and printing documents and a desired, constant document feed rate during both printing and non-printing conditions of operation.

Briefly stated, the document feeding apparatus in accordance with the invention comprises means for feeding the documents sequentially along a feed path to a print station including a print drum and a cooperating platen. At the print station the documents pass between the print drum and the platen for printing a message thereon. There is provided a direct current electric motor for driving the print drum as part of the document feeding apparatus and means controlling the voltage supplied to the motor for operating the same. The voltage controlling means includes a first voltage regulator circuit for supplying a first voltage to said motor for driving the print drum and feed apparatus at a speed to maintain a desired document feed rate during a non-printing condition of operation, and a voltage boost circuit for supplying a second voltage to said motor, a voltage greater than said first voltage, in response to the passage of a document through the print station for driving the print drum and feed apparatus to maintain said desired document feed rate during a printing condition of operation.

DETAILED DESCRIPTION OF THE PREFERRED EMBODIMENT

Figure 1:
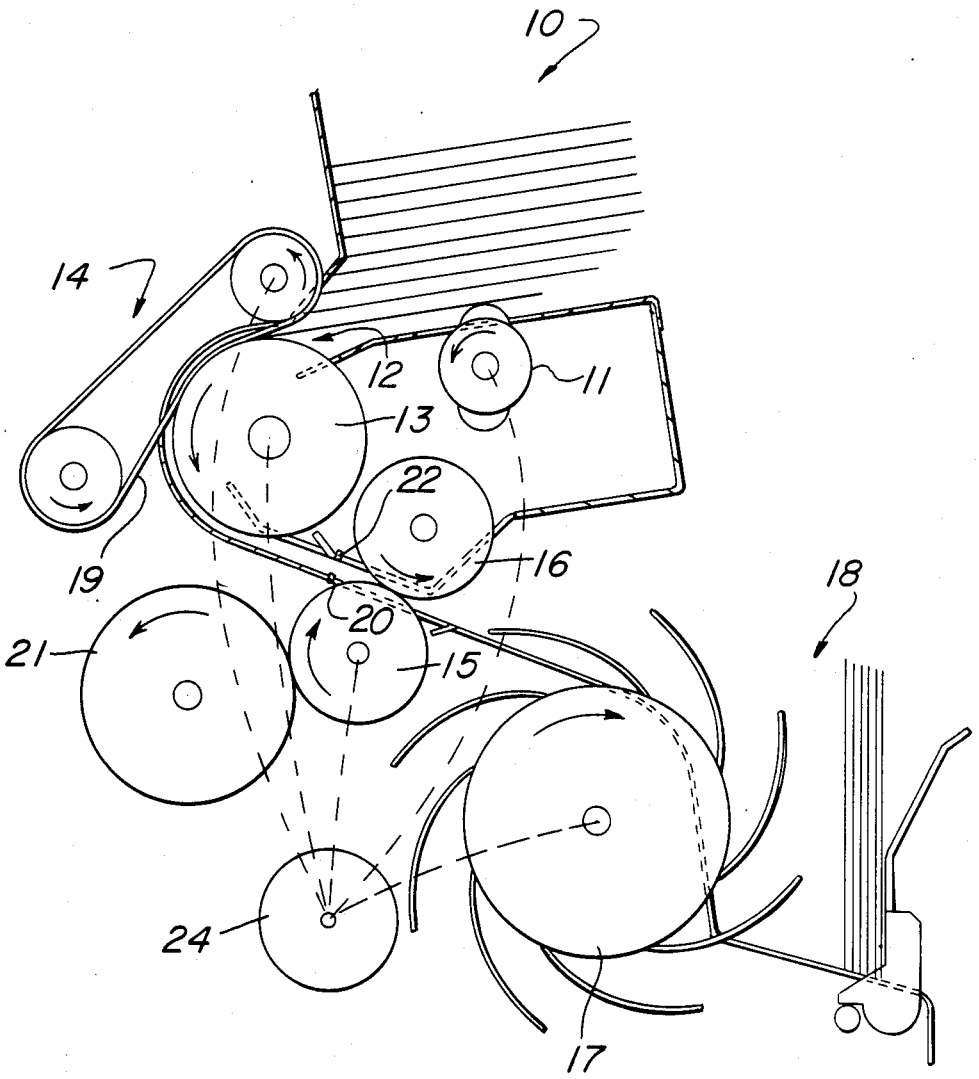
FIG. 1 is a partly diagrammatic view of a document feeding and printing apparatus.

FIG. 1 is a partly diagrammatic view showing a high speed document feeding and printing apparatus wherein the documents are fed from a supply hopper past a print station to an output stacker. As shown in this figure, the apparatus comprises a supply hopper 10, a picker 11, an input throat 12, a feed roller 13, a stripper mechanism 14, a print drum 15 and its associated platen 16, a stacker wheel 17 and an output stacker 18. The direction of movement of the parts is shown by the arrows in FIG. 1. The document feeding arrangement shown in FIG. 1 is essentially conventional.

In the use of the apparatus shown in FIG. 1, a stack of documents to be printed is placed in the supply hopper 10 and the lowermost document thereof is fed sequentially by the picker 11 into the input throat 12 from which the documents come into contact with the high friction surface of the feed roller 13. The feed roller 13 feeds the documents into contact with the lower friction belt 19 of the stripper mechanism 14 which supplies the normal force to hold the document in frictional engagement with the high friction surface of the feed roller 13 over the arcuate feed path where belt 19 and feed roller overlie each other. The counter-rotating movement of the stripper belt 19 will not be effective to prevent movement of the endmost document of the stack through the stipper mechanism, but the next document behind the endmost document is easily held back by the movement of the stripper belt 19 until the endmost document is fed through said arcuate path and the subsequent document can contact the high friction surface of the feed roller 13. When a document passes through the arcuate area where the feed roller 13 and the stripper belt 19 overlie each other, it is directed by suitable guide plates into the pinch of the print drum 15 and its associated platen 16.

The print drum 15 rotates at a high speed (typically two times that of the feed roller 13) so as to sequentially space the documents apart from one another once they have been separated by the stripper mechanism 14. As each document passes successively into the pinch of the print drum 15 and the platen 16, the print drum 15 effectively pulls it away from the feeder/stripper mechanism. Thus, for a time, the preceding document is moving faster than the following document in order to allow a space between sequential documents to facilitate the detecting and counting of the individual documents. As each document passes between the print drum 15 and the platen 16, the print drum 15 applies a fixed message onto the contacting surface of the document. Thus, the print drum 15 and the associated platen 16 form a print station for the apparatus. As is conventional, there is also provided an ink roller 21 positioned to contact the surface of print drum 15 to transfer ink thereto for the printing operation. The documents are guided from the exit side of the print station to the stacker wheel 17 which operates in a conventional manner to stack the documents in the output stacker 18.

There is also provided a document sensing means which senses the presence of a document at a location just prior to the entrance of a document into the print station. The document sensing means comprises a light emitting diode (LED) 20 located on one side of the document feed path and a light detector in the form of a phototransistor 22 located on the other side of the document feed path as shown in FIG. 1.

A direct current electric motor 24 is arranged, through belts, etc. engaged with the motor shaft, to drive the picker 11, the feed roller 13, the stripper mechanism 14, the print drum 15 and the stacker wheel 17.

In accordance with the invention there is provided novel means for controlling the voltage supplied to the electric motor 24. The circuit for the voltage control means is shown in FIG. 2 and, briefly stated, comprises a first voltage regulator circuit for supplying a first voltage to the motor 24 for driving the print drum 15 at the desired document feed rate in the non-printing operating condition of the apparatus and a voltage boost circuit for supplying to motor 24 a second voltage, which voltage is greater than said first voltage, in response to the passage of a document through said print station for operating the motor 24 to maintain said desired document feed rate during the printing condition of operation of the apparatus.

Figure 2:
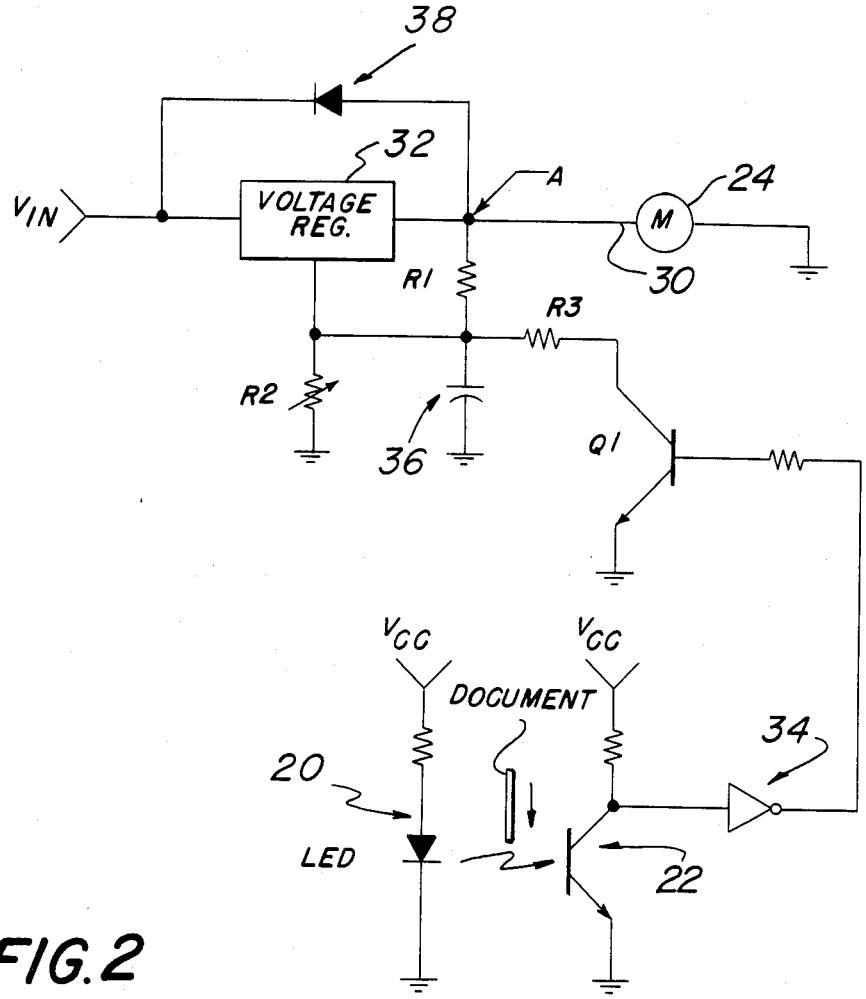
FIG. 2 is a diagrammatic view of the circuit for supplying the voltage to the motor which drives the print drum and the various other document feeding means.

As shown in FIG. 2, a line 30 is connected from a point or node A to the motor 24 for supplying the voltage (and hence the current) thereto, the motor voltage being controlled by the voltage at node A. The motor supply voltage $V_{IN}$ is connected through a constant voltage regulator 32 to node A and a circuit including combination of three resistors R1, R2 and R3 sets one level of voltage (the lower voltage) at node A. A second circuit (a voltage boost circuit) including a combination of a transistor Q1 and resistor R3 functions to change the voltage at node A when this circuit is activated as described hereafter. As is evident from FIG. 2, the shunt resistor R3 is connected in parallel with the resistor R1 and, when the circuit containing resistor R3 is active, the voltage at node A will be at the lower voltage. The second circuit also includes means for activating and deactivating the transistor Q1, such means comprising an inverter 34 which is driven from the phototransistor 22 by way of the association of phototransistor 22 with the light emitting diode (LED) 20. The LED 20 and phototransistor 22 are supplied from the logic supply voltage $V_{cc}$. LED 20 directs a light beam across the document feed path to phototransistor 22 which places the inverter 34 in a state to maintain the transistor Q1 active. This condition occurs when the light beam is not interrupted by a document and is detected by the phototransistor 22, which condition is the non-printing operating condition of the apparatus. However, the presence of a document breaking the light beam between the LED 20 and the phototransistor 22 (i.e., the printing condition of operation) changes the state of inverter 34 to deactivate the transistor Q1 to thereby remove the shunt resistor R3 from the system and raise (boost) the voltage at node A. Once a document being printed completes its interruption of the light beam (i.e., when it leaves the print station), the phototransistor 22 receives the light beam from LED 20 and changes the state of the inverter 34 back to that state whereupon the transistor Q1 is reactivated, thereby returning the voltage at node A to the original lower voltage maintained by the first circuit including resistors R1, R2 and R3.

The circuit shown in FIG. 2 comprises a capacitor 36 which functions as a filter to minimize ripple on the output. The circuit also includes a diode 38 which functions as a shunt diode to wrap around the regulator 32 to prevent brush spikes from the DC motor 24 from backing up into the regulator 32 by, in effect, bypassing such spikes into the input filter. The constant voltage regulator 32 is a conventional off-the-shelf type which is known as a linear, three-terminal regulator.

The elements of the circuit shown in FIG. 2 are designed such that when a document moves between the LED 20 and the phototransistor 22 to break the light beam, which occurs initially when the leading edge of the document moves to a location just prior to entering into the print station, the circuit will operate to boost the voltage at node A whereby the current driving the motor 24 is increased to a point such that, even though the load on the motor 24 has increased, it will operate to maintain the desired document feed rate during the printing operating condition. This desired document feed rate is the same rate that is maintained by the motor 24 during the non-printing operating condition when the voltage supply is under the control of the circuit including resistors R1, R2 and R3.

It will be apparent that the voltage control means in accordance with the invention maintains a document feed rate such that the system throughput is maintained at the same desired speed. This avoids the problems of the motor slowing down during a printing operating condition of the apparatus and then speeding up during a non-printing operating condition of the apparatus. Thus, by boosting the motor voltage during the printing operating condition, the entire system keeps at a uniform speed. In other words, it prevents overspeed and underspeed conditons of operation. This enables the apparatus to be designed to operate at a speed for achieving the desired document feed rate while maintaining a good printing action without smear or other problems. Thus, when it is determined that the machine is to run at a certain speed, for example, 600 documents per minute under the printing condition, the parts can be designed to maintain this condition of operation both during the printing and non-printing operating conditions of the apparatus.

What is claimed is:

1. For use in a document feeding and printing apparatus in which documents are fed sequentially from a supply thereof through a feed path including a print station, the combination comprising:

means for feeding documents sequentially along a feed path, means providing a print station including a print drum and a platen arranged to cooperate with said print drum during the printing of a document, said document feeding means delivering the documents to said print station whereat the documents pass between said print drum and platen for the printing of a message or the like thereon, a direct current electric motor driving said print drum, and means controlling the voltage supplied to said motor including a first voltage regulator circuit for supplying a first voltage to said motor for driving said print drum at a predetermined speed during a non-printing condition of operation, and a voltage boost circuit for supplying a second voltage to said motor greater than said first voltage in response to the passage of a document through said print station for driving said print drum at said predetermined speed during the printing condition of the apparatus, whereby said documents are fed through said print station at the same document feed rate during both the printing and non-printing operating conditions.

2. A combination according to claim 1 wherein said voltage control means includes a line connected from a node to said motor for supplying the voltage thereto, a constant voltage regulator connected to said node, said first voltage regulator circuit including a resistance circuit which sets one level of voltage at said node, said voltage boost circuit including a resistor and a transistor for setting said second voltage at said node.

3. A combination according to claim 2 including means for actuating said transistor between active and inactive states including an inverter driven from a phototransistor.

4. A combination according to claim 3 including means for sensing the presence of a document at said print station between said print drum and said platen, said sensing means including a light emitting diode located at said print station on one side of the document feed path and said phototransistor located at said print station on the other side of said document feed path and adapted to receive the light beam emitted by said light emitting diode.

5. The combination according to claim 4 wherein said phototransistor is constructed and arranged to detect the presence of a light beam during the non-printing operating condition of the apparatus and to determine that the light beam has been broken during the printing condition of operation of the apparatus.

* * * * *